US005459974A

United States Patent [19]

Barry et al.

[11] Patent Number: 5,459,974

[45] Date of Patent: Oct. 24, 1995

[54] ARCUATE CEILING STRUCTURE

[76] Inventors: Michael A. Barry, 615 S. State College Blvd., Fullerton, Calif. 92631; George E. Goodwin, 1551 S. Highland Apt. P., Fullerton, Calif. 92632

[21] Appl. No.: 228,144

[22] Filed: Apr. 15, 1994

[51] Int. Cl.[6] ..... E04B 1/32; E04G 21/00

[52] U.S. Cl. ..... 52/745.08; 52/745.07; 52/86; 52/247

[58] Field of Search ..... 52/86, 88, 245, 52/745.07, 745.08, 49.6, 246, 247, 329, 339, 650.3, 745.08

[56] References Cited

U.S. PATENT DOCUMENTS

| | | | |
|---|---|---|---|
| 468,354 | 2/1892 | Mayhew . | |
| 1,223,266 | 4/1917 | Dyer . | |
| 1,264,084 | 5/1918 | Knox | 52/86 |
| 1,762,363 | 10/1928 | Sergent . | |
| 1,938,024 | 12/1933 | Keeffe | 52/86 |
| 2,011,796 | 10/1934 | Christensen . | |
| 2,292,078 | 8/1942 | Inman et al. | 52/86 X |
| 2,335,708 | 11/1943 | Strobel | 52/86 X |
| 2,342,916 | 8/1944 | Blask | 52/86 |
| 2,736,397 | 2/1956 | Colby, Jr. | 52/86 X |
| 3,034,824 | 5/1962 | Schubach . | |
| 3,168,815 | 8/1959 | Blenkle et al. . | |
| 3,231,110 | 7/1885 | Carlewitz . | |
| 3,364,634 | 1/1968 | Allaire | 52/86 |
| 3,440,790 | 4/1969 | Nerem . | |
| 3,763,618 | 10/1973 | Bennett et al. | 52/741 |
| 4,301,632 | 11/1981 | Wagner | 52/211 |
| 4,601,138 | 7/1986 | Hampton | 52/86 |
| 4,642,955 | 2/1987 | Webb | 52/204 |
| 4,665,666 | 5/1987 | Hampton | 52/86 |
| 4,780,998 | 11/1988 | Knapp | 52/211 |
| 4,785,605 | 1/1988 | Jenn | 52/745.08 X |
| 4,955,168 | 9/1990 | Barry | 52/210 |

FOREIGN PATENT DOCUMENTS

| | | | |
|---|---|---|---|
| 0533433 | 4/1958 | Belgium | 52/80.1 |
| 1489329 | 4/1967 | France . | |
| 1059397 | 6/1964 | United Kingdom . | |

*Primary Examiner*—Carl D. Friedman
*Assistant Examiner*—Robert J. Canfield
*Attorney, Agent, or Firm*—Stetina Brunda & Buyan

[57] ABSTRACT

A device for forming an arcuate ceiling structure which is positionable between first and second opposed rows of vertical wall studs having at least one horizontal header extending therebetween. The device comprises a first ledger attached to the first row of wall studs and the second ledger attached to the second row of wall studs. At least one arcuate member is provided which has first and second longitudinal ends, an arcuate upper surface and an arcuate undersurface. The length between the first and second ends is such that when the arcuate member is positioned between the first and second ledgers, the first end will abut the first ledger, the second end will abut the second ledger, a portion of the upper surface will abut a header, and the undersurface will form an arcuate support surface to which a sheet of finishing material may be applied.

4 Claims, 1 Drawing Sheet

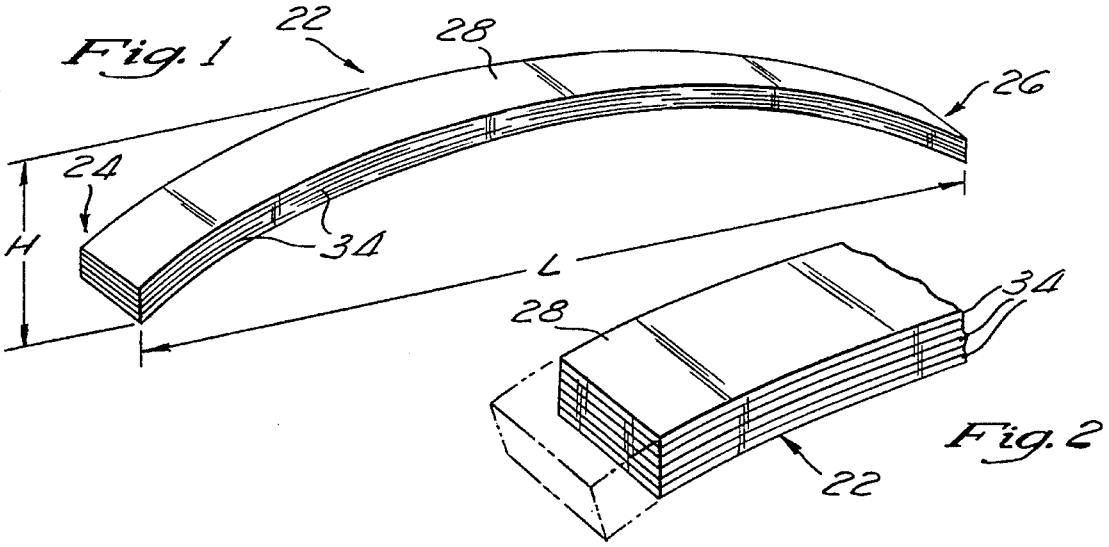
Fig. 1
Fig. 2
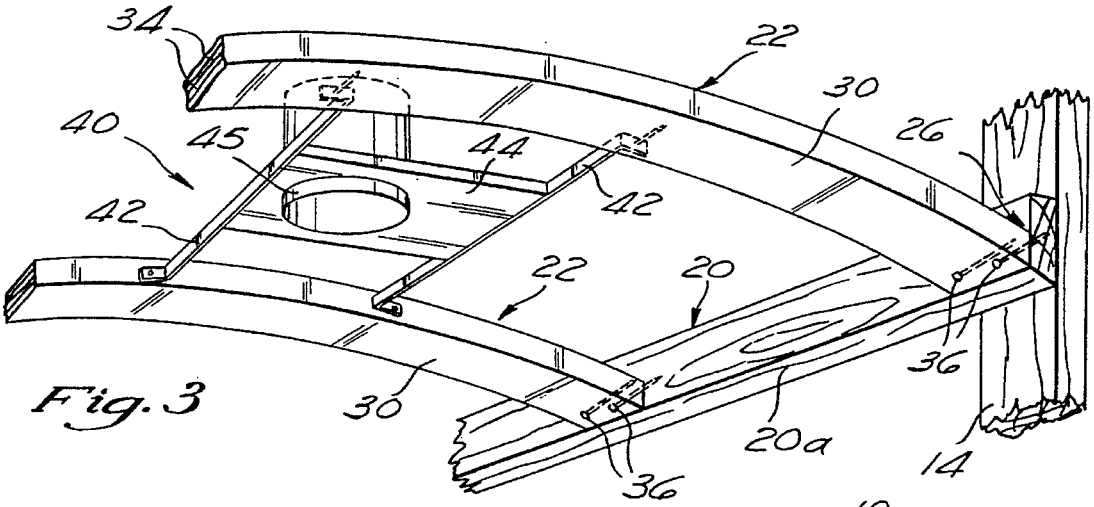
Fig. 3
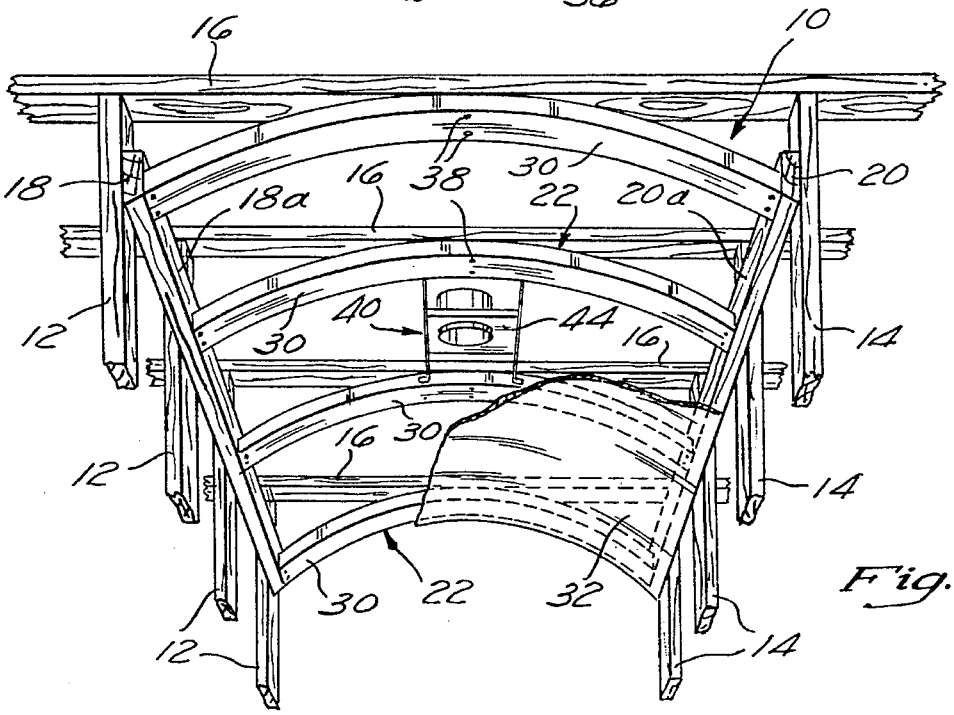
Fig. 4

ARCUATE CEILING STRUCTURE

FIELD OF THE INVENTION

The present invention relates generally to the art of building construction, and more particularly, to a device for forming an arcuate ceiling structure. The present invention is particularly applicable to new building construction and will be described herein with particular reference thereto, although it will be appreciated that the invention has broader applications and will also find utility as a retrofit item to be used in renovating or remodeling existing structures.

BACKGROUND OF THE INVENTION

The installation of arcuate ceilings in the hallways, foyers, closets or other rooms of a residential or commercial structure has heretofore required considerable skill and labor. In the prior art, the method of installing an arcuate ceiling structure typically begins by cutting two pieces of plywood to form arcuately contoured cut-outs therewithin. Thereafter, the two pieces of plywood are positioned in spaced relation between first and second opposed rows of vertical wall studs, with the vertical side edges of each piece of plywood being nailed to respective wall studs of the first and second rows. The horizontal top edge of each piece of plywood is then nailed to a respective one of the horizontal headers extending between the top ends of the vertical wall studs of the first and second rows. When the two plywood pieces are properly attached to the wall studs and headers, the arcuate cut-outs therewithin are disposed in co-planar relation to each other.

Subsequent to the attachment of the plywood pieces to the wall studs and headers, elongate wooden pieces (i.e., two-by-fours) are extended longitudinally therebetween. The opposed ends of the two-by-fours are positioned along the cut-outs formed in the plywood pieces so as to roughly approximate an arcuate pattern, and are subsequently nailed to respective ones of the plywood pieces. The central portions of the two-by-fours are then "blocked in" to provide support thereto. This is typically accomplished by cutting short sections of two-by-four or other wooden material to form nailing blocks which are extended between and nailed to the top edges of the two-by-fours and the bottom surfaces of the headers extending between the top ends of the vertical wall studs of the first and second rows. Thereafter, a sheet of drywall or other ceiling material is applied to the bottom edges of the two-by-fours and nailed thereto, thus forming the arcuate ceiling structure.

The above-described prior art method of installing an arcuate ceiling structure is known to be time consuming and expensive, and to result in non-uniform and oftentimes uneven interior ceiling surfaces. Because such defects are usually readily visible, the builder is often called upon to undertake remedial work after the ceiling and interior walls have been finished and painted. Thus, there exists a need in the art for a simple, inexpensive and uniformly shaped arcuate ceiling structure which may be positioned between first and second opposed rows of vertical wall studs in a manner creating a smoothly arched and uniform ceiling structure. In view of the deficiencies of the prior art, the present invention is intended to provide a desired inexpensive and simple arcuate ceiling structure which may be reproducibly manufactured in a range of sizes to accommodate various hallway, foyer, closet and room sizes and various construction methodology.

SUMMARY OF THE INVENTION

In accordance with the preferred embodiment of the present invention, there is provided a device for forming an arcuate ceiling structure which is positionable between first and second opposed rows of vertical wall studs having at least one horizontal header extending therebetween. The device comprises a first ledger which is attached to and extends horizontally along the first row of wall studs, and a second ledger which is attached to the second row of wall studs and extends in generally parallel relation to the first ledger. The device further comprises a series of arcuate members, each of which defines first and second longitudinal ends, an arcuate upper surface and an arcuate undersurface. The length between the first and second ends of the arcuate members is such that when the arcuate members are positioned between the first and second ledgers, the first ends will abut the first ledger, the second ends will abut the second ledger, and a portion of the upper surface of at least one of the arcuate members will abut a header. Additionally, the undersurfaces of the arcuate members will be disposed in coplanar relation to each other thus forming an arcuate support surface to which a sheet of finishing material such as drywall may be applied.

Each of the arcuate members may comprise a laminate structure consisting of individual thin wooden members formed around an arcuate jig and bonded in juxtaposition to one another so as to provide a unitary laminated structure of predetermined length and thickness. Similarly, thin strips of wooden, paper, textile or other materials may be laid upon a rotating circular mandrel with appropriate bonding agents being applied to provide a generally rigid, circular laminated member. Such circular member may be cut into multiple arcuate (i.e., semi-circular) sections. Each of the arcuate members may also be formed of bonded particles or fibrous materials. The particulate or fibrous material, along with any binding agents or other ingredients, may be poured or injected into an arcuate or circular mold. Under sufficient temperature, pressure and other conditions, the desired arcuate or circular structure will thus be formed within the mold. If a full circular mold is used, the circular member so formed will subsequently be cut into multiple arcuate (i.e., semi-circular) members. The arcuate members may be specifically sized to form an arcuate ceiling structure within a desired area of the residential or commercial structure and/or to accommodate a specific type of ceiling construction.

Further in accordance with the present invention, there is provided a method of installing an arcuate ceiling structure between first and second opposed rows of vertical wall studs having at least one horizontal header extending therebetween. The method comprises the steps of attaching a first ledger to the first row of vertical wall studs and attaching a second ledger to the second row of vertical wall studs in a manner wherein the second ledger extends in generally parallel relation to the first ledger. At least two arcuate members are provided, each of which defines opposed ends, an arcuate upper surface and an arcuate undersurface, and has a longitudinal dimension approximately equal to the distance between the first and second ledgers. The arcuate members are slidably positioned between the first and second ledgers, with a portion of the upper surface of at least one of the arcuate members being abutted against a header and the undersurfaces being disposed in coplanar relation to each other. Thereafter, the opposed ends of the arcuate members are affixed to the first and second ledgers, with the arcuate member which is abutted against the header being affixed thereto. Finally, a sheet of finishing material such as drywall is attached to the coplanar undersurfaces of the arcuate members thus forming the arcuate ceiling structure. The method may include the further step of attaching a light fixture to an adjacent pair of arcuate members.

BRIEF DESCRIPTION OF THE DRAWINGS

These, as well as other features of the present invention will become more apparent upon reference to the drawings wherein:

FIG. 1 is a perspective view of an arcuate member used in the arcuate ceiling structure of the present invention;

FIG. 2 is a partial perspective view illustrating one embodiment of the arcuate member as formed from a plurality of laminated members;

FIG. 3 is a partial perspective view of the arcuate ceiling structure, illustrating the manner in which a light fixture is interfaced thereto; and FIG. 4 is a perspective view of the arcuate ceiling structure of the present invention.

DETAILED DESCRIPTION OF THE PREFERRED EMBODIMENT

Referring now to the drawings wherein the showings are for purposes of illustrating a preferred embodiment of the present invention only, and not for purposes of limiting the same, FIG. 4 perspectively illustrates a device 10 for forming an arcuate ceiling structure which is positionable between first and second opposed rows of vertical wall studs 12, 14. Attached to and extending horizontally between the top ends of respective pairs of the wall studs 12, 14 of the first and second rows are a plurality of headers 16. The wall studs 12, 14 and headers 16 each typically comprise two-by-fours or similar lumber.

In the preferred embodiment, the device 10 comprises a first elongate ledger 181which is attached to and extends horizontally along each of the wall studs 12 of the first row. Attached to and extending horizontally along the wall studs 14 of the second row in generally parallel relation to the first ledger 18 is a second identically configured ledger 20. The first and second ledgers 18, 20 are attached to their respective rows of wall studs 12, 14 in a manner wherein the top edges thereof are equidistantly spaced from the bottom surfaces of the headers 16. As seen in FIGS. 3 and 4, the bottom edges of the first and second ledgers 18, 20 are beveled and slope upwardly toward the headers 16 when attached to their respective rows of wall studs 12, 14. The first and second ledgers 18, 20 are preferably fabricated from wood, and attached to the wall studs 12, 14 through the use of nails or similar fasteners.

Referring now to FIGS. 1–4, in addition to the first and second ledgers 18, 20, the device 10 comprises at least one, and preferably a series of, identically configured arcuate members 22. Each arcuate member 22 defines first and second opposed longitudinal ends 24, 26, an arcuate upper surface 28 and an arcuate undersurface 30. In each arcuate member 22, the critical dimensions are the longitudinal length L which is the distance between the first and second ends 24, 26, and the height H which is the distance between the lower-most edges of the first and second ends 24, 26 and the highest point of the upper surface 28.

In the preferred embodiment, the length L of the arcuate members 22 is such that when positioned between the first and second ledgers 18, 20, the first ends 24 will abut the first ledger 18 and the second ends 26 will abut the second ledger 20. Additionally, the height H of the arcuate members 22 is such that portions of the upper surfaces 28 thereof (i.e., the highest points) will abut the bottom surface of respective ones of the headers 16. Importantly, when the arcuate members 22 are positioned in this manner (i.e., with the first and second ends 24, 26 abutted against the first and second ledgers 18, 20 and the upper surfaces 28 abutted against the headers 16) the under surfaces 30 will be disposed in co-planar relation to each other thus forming an arcuate support surface to which a sheet of finishing material 32 such as drywall may be applied.

As best seen in FIG. 2, each arcuate member 22 is preferably formed by the laminar disposition of multiple wood laminate layers 34 which are fused together to form a unitary, laminated structure. The individual laminate layers 34 are typically formed around an arcuate jig structure with the glue or other binding agent being interfacially deposit between the individual laminate layers 34 so as to result in a rigid, laminated structure having the desired arcuate shape. Alternatively, the arcuate member 22 may be formed from bonded particulate matter including cellulose fiber, shredded paper, wooden particles, sawdust, and possible combinations thereof. A quantity of these wooden or paper particles are typically placed into an arcuate or circular mold along with various binding agents or other chemicals capable of resulting in a composite structure of sufficient integrity to serve the desired functions of the present invention. The arcuate member 22 may also be formed from strips of various wooden, paper, textile or other materials which are applied along with appropriate bonding agents to a rotating circular mandrel to form a laminated circular member. As will be recognized, in those instances when the arcuate member 22 is formed through the utilization of a circular mold or a circular mandrel, the resulting circular laminated or molded member will be cut to form multiple arcuate (i.e., semicircular) members. Subsequent to the formation of the arcuate member 22 by any one of the aforementioned procedures, the opposed end portions thereof (shown in phantom in FIG. 2) are cut away so as to define the first and second ends 24, 26 which extend vertically along parallel planes. Finally, each arcuate member 22 may be formed from a plastic material.

In the preferred embodiment, an arcuate ceiling structure is installed by initially attaching the first ledger 18 to the vertical wall studs 12 of the first row such that the first ledger 18 extends horizontally along the wall studs 12 in close proximity to the top ends thereof. Thereafter, the second ledger 20 is extended horizontally along and attached to the vertical wall studs 14 of the second row in generally parallel relation to the first ledger 18. The first and second ledgers 18, 20 are extended along and attached to their respective rows of wall studs 12, 14 such that the top edges thereof are spaced equidistantly from the headers 16, and the beveled bottom edges thereof slope upwardly toward the headers 16.

Subsequent to the attachment of the first and second ledgers 18, 20 to the first and second rows of wall studs 12, 14, the arcuate members 22 are slidably positioned between the first and second ledgers 18, 20. The longitudinal dimension (i.e., the length L) of each of the arcuate members 22 is approximately equal to the distance between the inner surfaces 18*a*, 20*a* of the first and second ledgers 18, 20, thus allowing the arcuate members 22 to be slidably positioned therebetween. Each arcuate member 22 is oriented such that its first end 24 is abutted against the inner surface 18*a* of the first ledger 18, and its second end 26 is abutted against the inner surface 20*a* of the second ledger 20, with the arcuate undersurface 30 being substantially continuous (i.e., flush)

with the beveled bottom edges of the first and second ledgers 18, 20. Additionally, each arcuate member is positioned along the first and second ledgers 18, 20 so as to extend between a respective pair of the wall studs 12, 14 of the first and second rows. Importantly, the height H of each arcuate member 22 is such that when properly positioned between the first and second ledgers 18, 20 and attached thereto, the highest point of its upper surface 28 will be abutted against the bottom surface of a respective one of the headers 16.

As seen in FIG. 3, the attachment of the first and second ends 24, 26 of each arcuate member 22 to the first and second ledgers 18, 20 is facilitated by the extension of fasteners such as nails 36 diagonally upward through the undersurface 30 of the arcuate member 22 and into the inner surfaces 18*a*, 20*a* of the first and second ledgers 18, 20. Each arcuate member 22 is affixed to a respective header 16 via the extension of fasteners such as nails 38 upwardly into the highest point of the undersurface 30 and into the bottom surface of the header 16. As an alternative to the nails 36, 38 it will be recognized that other connecting means such as brads, corrugated connectors or any other apparatus capable of joining wooden members may be also utilized.

Subsequent to the attachment of the arcuate members 22 to the first and second ledgers 18, 20 and headers 16 in the aforementioned manner, the sheet of finishing material 32 is attached to the undersurfaces 30 of the arcuate members 22 and to the beveled bottom edges of the first and second ledgers 18, 20. When properly attached to the arcuate members 22 and first and second ledgers 18, 20, the sheet of finishing material 32 is smoothly contoured due to the continuous arcuate transition between the undersurfaces 30 of the arcuate members 22 and the bottom edges of the first and second ledgers 18, 20.

The preferred method of installing the arcuate ceiling structure may further comprise the step of attaching a light fixture 40 to an adjacent pair of arcuate members 22. As seen in FIGS. 3 and 4, the light fixture 40 preferably comprises a pair of struts 42 which are attached to and extend laterally between the longitudinal side edges of the adjacent pair of arcuate members 22 in parallel relation. Extending between the struts 42 is a light source 44 which is disposed centrally between the adjacent pair of arcuate members 22. As will be recognized, when the light fixture 40 is attached to the arcuate members 22, the sheet of finishing material 32 subsequently applied to the undersurfaces 30 will be cut to accommodate at least the cylindrical center portion 45 of the light source 44.

The arcuate members 22 of the device 10 are preferably manufactured with predetermined length L and height H dimensions so as to allow the device 10 to be quickly and easily installed between existing rows of vertical wall studs or within an alternative type of ceiling construction. Additionally, it will be recognized that the device 10 need not include the first and second ledgers 18, 20, and that the length L and height H dimensions of the arcuate members 22 may be selected such that the first and second ends 24, 26 thereof may be abutted directly against and attached to respective pairs of the vertical wall studs 12, 14 of the first and second rows, with the highest points of the upper surfaces 28 being abutted against and affixed to the bottom surfaces of respective headers 16.

The device 10 constructed in accordance with the present invention may include a single arcuate member 22 of a particular length L and height H dimension, or may include a series of arcuate members 22, with the term "series" constituting two or more arcuate members 22. Additionally, though the arcuate members 22 are preferably affixed to respective ones of the headers 16, each arcuate member 22, and in particular certain ones of the interior arcuate members 22 of the device 10, need not be affixed to a header 16. Indeed, in certain wall and ceiling frames, headers 16 may not be extended horizontally between each pair of wall studs 12, 14 of the first and second rows.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A method of installing an arcuate ceiling structure between first and second opposed rows of vertical wall studs having at least one horizontal header extending therebetween, said method comprising the steps of:

providing at least two arcuate members, each of which defines opposed ends, an arcuate upper surface and an arcuate undersurface, and has a longitudinal dimension approximately equal to the distance between the first and second rows of vertical wall studs;

positioning the arcuate members between respective wall studs of the first and second rows;

abutting a portion of the upper surface of at least one of the arcuate members against a header;

disposing the undersurfaces of the arcuate members in coplanar relation to each other;

affixing the opposed ends of said arcuate members to the vertical wall studs of the first and second rows;

affixing the arcuate member abutted against the header to the header; and attaching a sheet of finishing material to the coplanar undersurfaces of the arcuate members so as to form the arcuate ceiling structure.

2. The method of claim 1 further comprising the step of attaching a light fixture to an adjacent pair of arcuate members.

3. A method of installing an arcuate ceiling structure between first and second opposed rows of vertical wall studs having at least one horizontal header extending therebetween, said method comprising the steps of:

attaching a first ledger to the first row of vertical wall studs;

attaching a second ledger to the second row of vertical wall studs in a manner wherein the second ledger extends in generally parallel relation to the first ledger;

providing at least two arcuate members, each of which defines opposed ends, an arcuate upper surface and an arcuate undersurface, and has a longitudinal dimension approximately equal to the distance between the first and second ledgers;

positioning the arcuate members between said first and second ledgers;

abutting a portion of the upper surface of at least one of the arcuate members against a header;

disposing the undersurfaces of the arcuate members in coplanar relation to each other;

affixing the opposed ends of said arcuate members to the first and second ledgers;

affixing the arcuate member abutted against the header to the header; and attaching a sheet of finishing material to the coplanar undersurfaces of the arcuate members and the first and second ledgers so as to form the arcuate ceiling structure.

4. The method of claim 3 further comprising the step of attaching a light fixture to an adjacent pair of arcuate members.

* * * * *